US005921034A

United States Patent [19]

Tobin

[11] Patent Number: 5,921,034

[45] Date of Patent: Jul. 13, 1999

[54] TRANSPORTABLE WORKSHOP

[76] Inventor: Timothy J. Tobin, 4214 Rome West Rd., Chillicothe, Ill. 61523

[21] Appl. No.: 08/850,619

[22] Filed: May 2, 1997

[51] Int. Cl.[6] ..... E02D 35/00

[52] U.S. Cl. ..... 52/122.1; 52/79.9; 52/143; 52/125.2

[58] Field of Search ..... 52/79.5, 79.1, 52/143, 79.9, 125.2, DIG. 14, 122.1, 745.19, 745.2; 220/1.5

[56] References Cited

U.S. PATENT DOCUMENTS

| | | | |
|---|---|---|---|
| 3,069,224 | 12/1962 | Bigelow | 52/79.9 X |
| 3,527,008 | 9/1970 | Greenhalgh | 52/125.2 X |
| 3,600,870 | 8/1971 | Greenhalgh | 52/125.2 X |
| 3,683,571 | 8/1972 | Walz et al. | 52/125.2 |
| 3,990,197 | 11/1976 | Johnston | 52/125.2 |
| 4,016,951 | 4/1977 | Dick | 52/143 X |
| 4,127,199 | 11/1978 | Clethero | 52/125.2 X |
| 4,467,585 | 8/1984 | Busby | 52/122.1 X |
| 4,470,227 | 9/1984 | Bigelow et al. | 52/143 X |
| 4,478,467 | 10/1984 | Tyndall | 52/79.5 X |
| 4,644,708 | 2/1987 | Baudot | 52/79.9 |
| 4,731,964 | 3/1988 | Phillips | 52/79.9 X |
| 4,802,813 | 2/1989 | Perry | 52/125.2 X |
| 5,012,621 | 5/1991 | Power | 52/122.1 X |
| 5,036,634 | 8/1991 | Lessard | 52/264 X |
| 5,315,794 | 5/1994 | Pearson | 52/169.6 X |
| 5,661,930 | 9/1997 | Porter | 52/125.2 X |

*Primary Examiner*—Beth A. Aubrey
*Attorney, Agent, or Firm*—Paul H. Gallagher

[57] ABSTRACT

A self-contained compartment used in a construction site. It is all-steel, and it includes vertical lifting plates forming hooks welded to the frame of the compartment for insertion of the bucket of a construction machinery piece for carrying it.

7 Claims, 3 Drawing Sheets

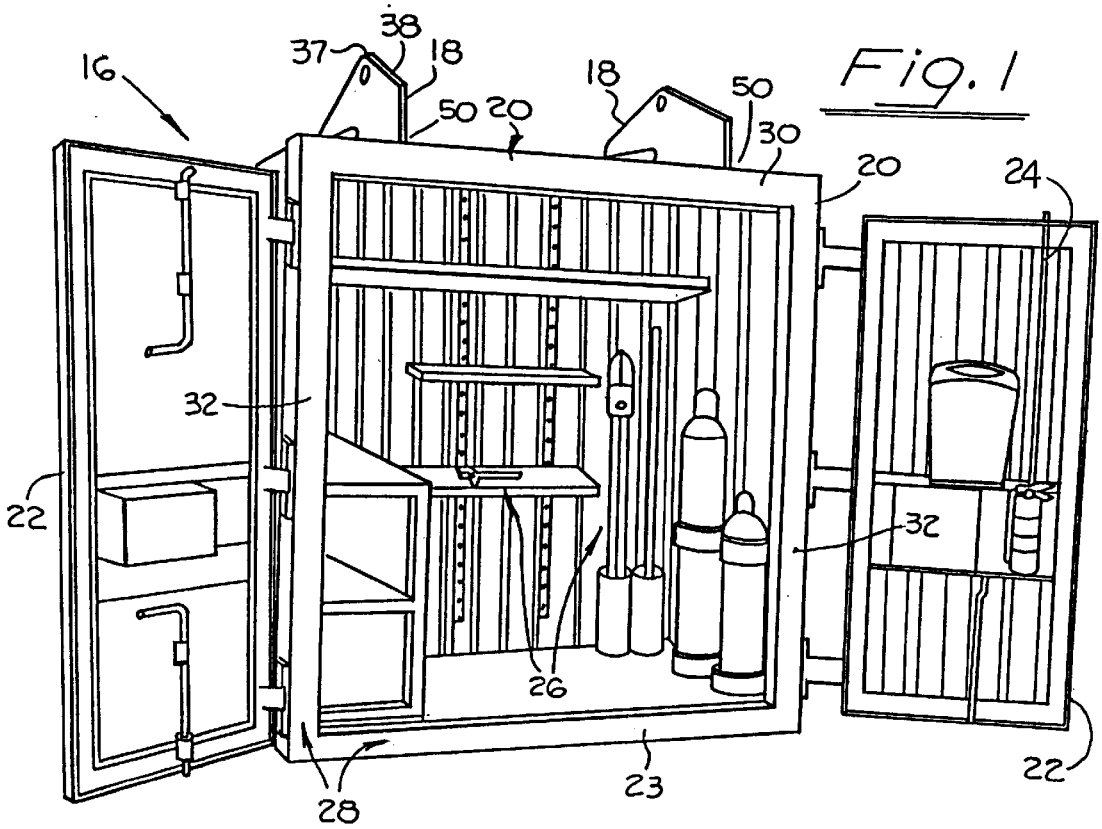
Fig. 1
Fig. 2
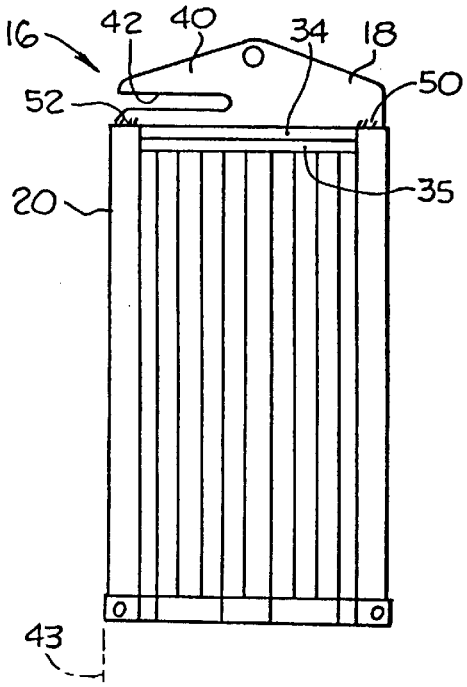
Fig. 3
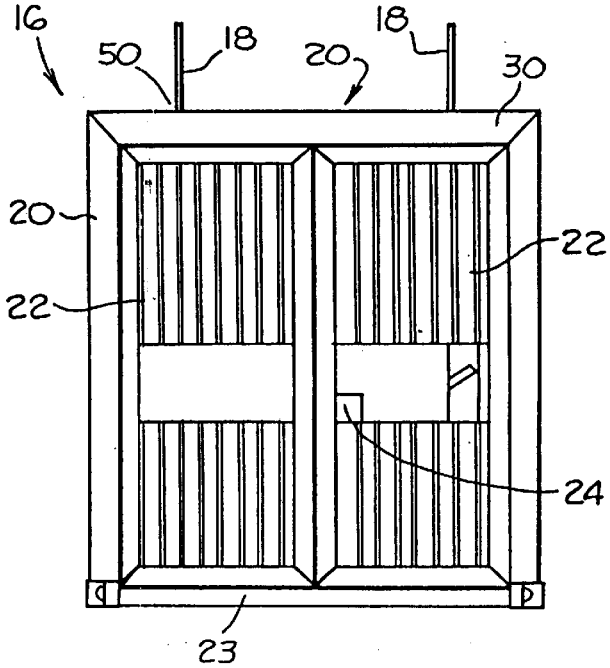

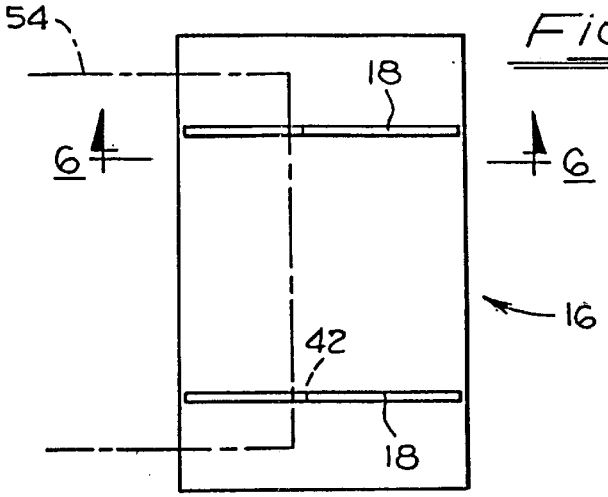
Fig. 4
Fig. 5
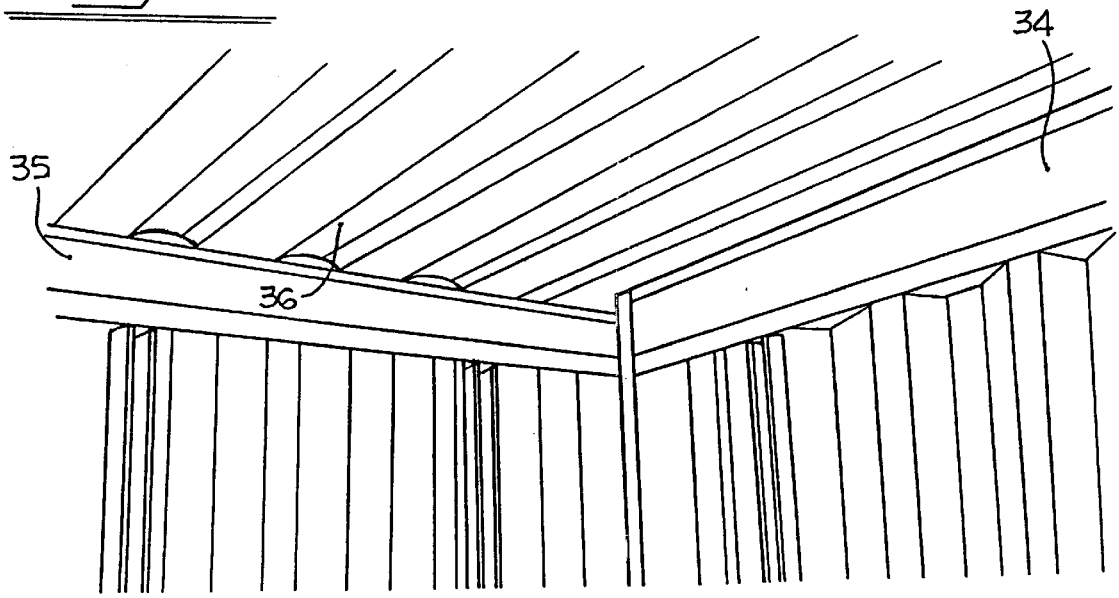
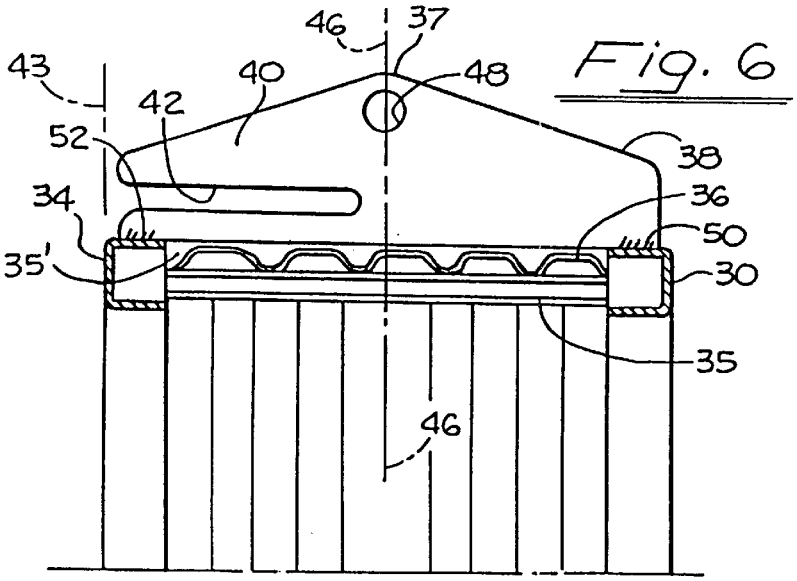
Fig. 6

TRANSPORTABLE WORKSHOP

SUMMARY OF THE INVENTION

The workshop of the present invention is for use especially in a construction site.

A typical construction site for which the workshop of the present invention is adapted, is construction of a road, for example. A workshop is needed at the immediate point of activity and it must be portable, because as the construction progresses, the workshop must be moved along. A workshop of this general kind, known also as a security workshop, has been in use for a considerable amount of time, but heretofore it has been very inconvenient and indeed cumbersome to move the workshop in the manner desired, resulting in corresponding increase in expense.

In a construction operation, various pieces of construction machinery are utilized, such as back hoes, lift forks, etc.

The workshop of the present invention is adapted to the use of ordinary pieces of machinery for moving it, and accordingly a main object of the invention is to provide such a portable or transportable workshop that is easily movable by ordinary construction machinery.

More particularly, the main object is to provide in the workshop itself, integral hooks that are adapted to use by a piece of construction machinery such as a back hoe or a lift truck.

A further and more specific object is related to the character of the workshop itself. The workshop is made up of welded pieces, which form the framework and the enclosing walls and doors. These pieces are all integrally welded into a single unitary and integral construction, and the device of the present invention utilizes that feature in providing lifting hooks that are also unitary with the workshop itself, in a design and arrangement which is extremely simple, and correspondingly inexpensive to fabricate.

A still further object is to provide such a transportable or portable workshop that its simplicity also is a great advantage in utilizing an ordinary piece of construction machinery for transporting it.

BRIEF DESCRIPTION OF THE INDIVIDUAL FIGURES OF THE DRAWINGS

FIG. 1 is a perspective view of a workshop, in position for use and with the doors open, that includes the features of the present invention.

FIG. 2 is an end view of the workshop.

FIG. 3 is a front view with the doors closed.

FIG. 4 is a top view, with an indication of the bucket of a piece of construction machinery.

FIG. 5 is a fragmentary perspective view of a corner of the construction, taken from the inside of the workshop.

FIG. 6 is a transverse vertical sectional view of the upper part of the workshop, taken on line 6—6 of FIG. 4.

DETAILED DESCRIPTION OF THE DRAWINGS

Figure 7:
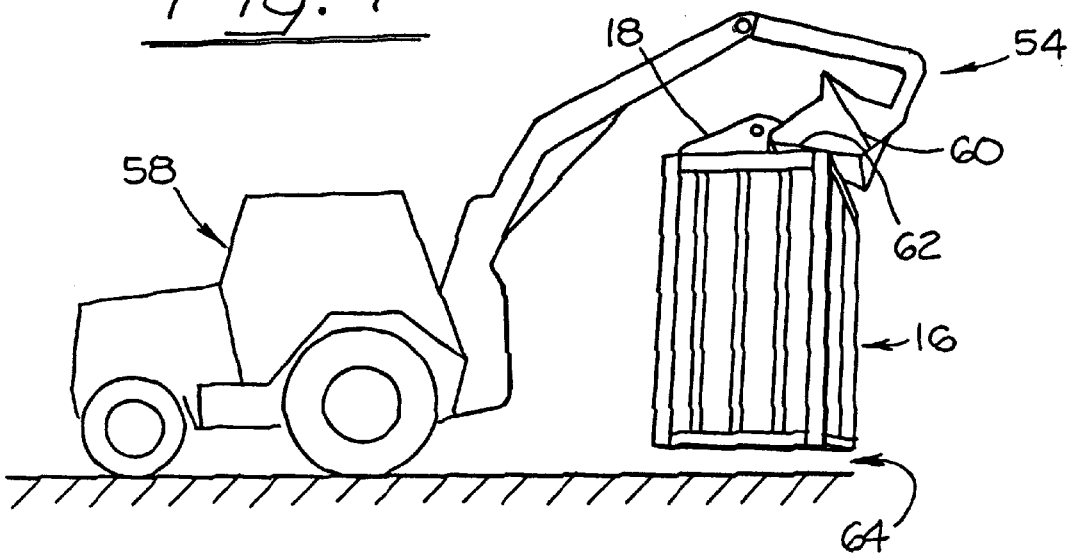
FIG. 7 is semi-diagrammatic view of the workshop picked up by a back hoe.

FIG. 1 shows a workshop or tool storage compartment with the lifting feature of the present invention embodied therein. The storage compartment itself is indicated at 16, and the lifting plates or hooks of the present invention are indicated at 18. There are two such lifting plates as will be described hereinbelow.

In keeping with the general nature of the basic device, in which the feature of the present invention is incorporated, the compartment or unit 16 is self-contained and is made completely of welded pieces of steel or iron forming a unitary and integral device. The compartment includes a main shell or housing element 20 and doors 22 hinged thereon, which are swingable to closed position as shown in FIG. 3, and are locked in closed position by suitable locking means 24 of known kind. Incorporated in the shell 20, i.e. in the compartment, are various tools and implements indicated generally at 26 for use in the construction operation, and these are held in place by suitable and known means for securing them in place while the entire unit is transported or moved.

The compartment or unit 16 is necessarily of extremely strong construction, including rigid and strong frame members. The front of the compartment, which is shown open in FIG. 1, is surrounded by rectangular frame means 28 which includes a top beam 30, side pieces or stiles 32 and a bottom piece or tread 23.

A similar structural arrangement is incorporated at the rear, which includes elements corresponding to the elements of the frame 28, and particularly a top beam 34 as shown in FIGS. 5, 6.

The frame includes top side beams 35 located at the sides of the compartment, top surfaces of the top beams 30,34 are spaced from top surfaces of the top side beams 35 forming a space 35' therebetween. A corrugated roof 36 is welded to the beams 35, being confined in the space 35'.

The device is in the form of an enclosing box, the walls of which are to be interpreted as including the roof and floor, as well as the sides. The parts and pieces of the device are so arranged and secured together that the two top beams 30, 34 form a main component for application thereto of the lifting plates 18. These lifting plates are two in number, and identical, arranged vertically and secured to the top edge of the top frame beams 30, 34. The plates may be for example of 2–3" in thickness, and of a height, or depth, according to the strength desired. They are essentially the length of the dimension of the compartment in front to back direction.

The compartment or basic unit may be any of various sizes, according to intended use, but a suitable or practical size may be 8'6" in height, 7'5" in width, and 5' in depth, i.e. from front to rear, thus being of walk-in size. Such a compartment, made of steel or iron, is of course extremely heavy, in this case being for example about 1½ tons.

The lifting plates 18 may be for example 2'6" high at the center, at 37 (FIG. 1,6), and about 12" high at the rear indicated at 38.

Each lifting plate 18 has a hook 40 forming a slot or pocket 42. The ends of the hooks are positioned at the plane 43 of the back side wall (FIGS. 2,6), and the slot extends to adjacent the vertical median line 46. The length of this slot may vary somewhat and need not be exactly of any particular length.

Each plate is also preferably provided with a hole 48 at the center, and adjacent the top of the plate. The use of this hole will be referred to again hereinbelow.

The two lifting plates 18 are welded to the top beams at points 50, 52. They are spaced apart transversely of the compartment, as shown in FIG. 3, and in the size of the compartment identified above, they may be 4'9" apart, or more than half the width of the compartment, to provide a sturdy and stable support.

The device utilizes the lifting plates as a part of the integral construction of the compartment, the space 35' accommodating the roof 36, and the lifting plates being secured only at the points of welding 50, 52.

FIG. 7 indicates the lifting and transporting of the device. In this figure a back hoe 58 is shown, having a bucket 54 at the extended end of its derrick, as is known. When it is desired to lift and transport the compartment, the back hoe is positioned as shown in FIG. 7 and the bucket 54 is inserted in the slots or pockets 42 of the lifting plates. This bucket has a lower surface 62, with teeth at the forward end, or left hand end as oriented in FIG. 7, and it is run into the slot the intended extent, such as by actually engaging the front edge of the bucket with the rear edge surface of the slot. Then the compartment is lifted to a suitable extent, such as 1–2' above the ground as indicated at 64, and supported entirely by the back hoe, and carried to a new location in the construction site.

Figure 8:
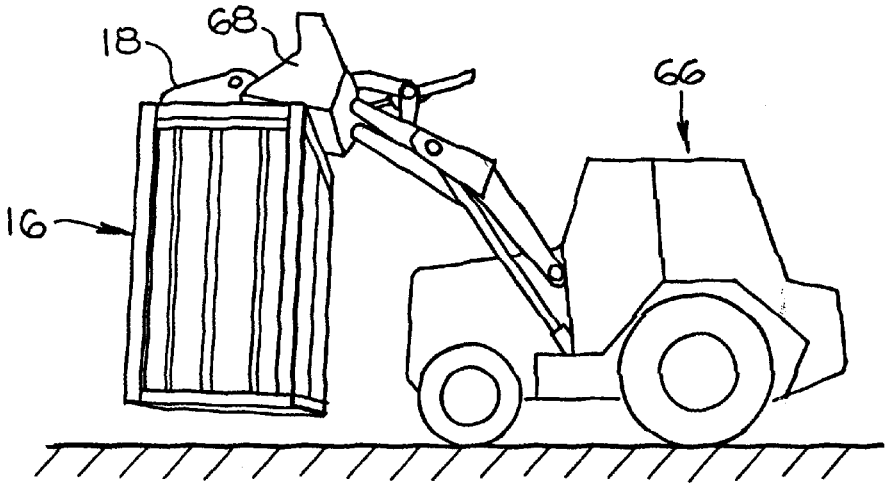
FIG. 8 is a semi-diagrammatic view of the workshop picked up by a front end loader.

FIG. 8 is a view similar to FIG. 7, but utilizing a front end loader 66. Such a front end loader has a bucket 68 which is run into the slots as in the case of the back hoe, and lifts the entire compartment, such lifted position being shown in FIG. 8. In this case similarly, it is then transported or carried to the intended new location. The bucket, 54 or 68, when holding the compartment, is preferably tilted upwardly, i.e. counterclockwise as shown in the figures, to position the compartment at a slight acute angle so as to prevent the compartment from slipping off the bucket. The compartment is thus carried without swinging, and it simply follows the movements of the bucket itself, forming a 2-point lifting system.

The back hoe and front end loader (FIGS. 7, 8) are very common pieces of machinery used in construction operations. These are very mobile pieces, and can easily be manipulated relative to the compartment, to put the vehicle in the intended lifting position. Thus the operation of transporting or moving the compartment is extremely simple. Merely utilizing the intended vehicle 58 or 66, which is usually close at hand, is extremely simple.

The design of the construction, and particularly the utilization of the lifting plates on the welded compartment, is also extremely simple. This feature consists only of putting the two plates in position, with substantially no modification of the construction of the compartment itself. Another advantageous feature is that in the movement of the compartment, it is relatively steady, being supported semi-rigidly, as contrasted with swinging when carried by an overhead crane with a flexible cable.

Notwithstanding the use of the slots 42 and utilizing a bucket, in an emergency situation, if it is necessary, an overhead crane with a flexible chain can be utilized, by connecting the latter in the holes 48 in the lifting plates, this notwithstanding the fact that the preferred manner of moving the device is by means of the hooks.

I claim:

1. A self-contained, enclosed, portable security compartment, the compartment comprising a frame including a top, a front wall, a back wall, side walls, and an interior, the walls welded together, the front wall having a door therein for providing access to the interior of the compartment, the compartment including vertical lifting plates attached at the top of the compartment, each of the lifting plates having a slot formed therein, each slot forming a hook at an upper portion of the slot, the lifting plates being substantially parallel to one another in a common horizontal plane, each slot being capable of receiving a rigid member such as a rigid bottom element of a bucket of a digging machine, the rigid bottom element being engageable with the hooks for lifting and transporting the compartment, whereby the compartment can be completely supported by the bucket thereby preventing the compartment from swinging.

2. The self-contained compartment according to claim 1 wherein, the hooks have free ends positioned adjacent the plane of one of said walls and thereby the slots have open ends also positioned adjacent said plane.

3. The self-contained compartment according to claim 1 wherein, the lifting plates also have holes with continuous peripheries, for receiving lifting elements therein.

4. The self-contained compartment according to claim 2 wherein, the lifting plates spaced apart a distance greater than half the width of the compartment, and the hooks are rigidly secured to the frame, whereby the bucket, in response to insertion into the slots, carries the compartment without swinging and only in movements following movements of the bucket.

5. The compartment according to claim 1 wherein, the compartment includes a roof at the top of the compartment, the roof having side beams located adjacent the side walls, and top beams located adjacent the front wall and the back wall, the lifting plates being rigidly secured to the top beams and spaced from the side beams, whereby a space is formed between the lifting plates and the side beams, and a corrugated roof beam is welded to the side beams and located within the space.

6. A method of transporting a self-contained portable compartment by a piece of mobile machinery having a bucket with a flat, rigid bottom element, in a construction operation at a site where the center of the construction moves along the site as construction progresses, and a crew utilizes said piece of mobile machinery, comprising, providing said self-contained portable compartment and setting it on the ground, providing plates at the top of the compartment, and providing horizontal slots in the plates opening horizontally, thereby forming hooks above the slots, and utilizing said piece of mobile machinery and inserting the bottom element of the bucket into the slots in engagement with the hooks and lifting the compartment thereby, and carrying it to a new location and setting it on the ground.

7. The method according to claim 6 and including the step, securing the lifting plates rigidly to the compartment.

* * * * *